US007175478B2

(12) United States Patent
Ollivier

(10) Patent No.: US 7,175,478 B2
(45) Date of Patent: Feb. 13, 2007

(54) MODULAR ELECTRIC TERMINAL CONNECTOR, IN PARTICULAR FOR A MONO-BODY PROBE OF DEFIBRILLATION

(75) Inventor: Jean Francois Ollivier, Villiers le Bacle (FR)

(73) Assignee: ELA Medical S.A.S., Montrouge (FR)

( * ) Notice: Subject to any disclaimer, the term of this patent is extended or adjusted under 35 U.S.C. 154(b) by 0 days.

(21) Appl. No.: 11/228,557

(22) Filed: Sep. 16, 2005

(65) Prior Publication Data

US 2006/0068645 A1 Mar. 30, 2006

(30) Foreign Application Priority Data

Sep. 20, 2004 (FR) ..... 04 09918

(51) Int. Cl.
*H01R 24/04* (2006.01)

(52) U.S. Cl. ..... 439/669; 439/909

(58) Field of Classification Search ..... 439/669, 439/909, 668
See application file for complete search history.

(56) References Cited

U.S. PATENT DOCUMENTS 5,267,564 A * 12/1993 Barcel et al. ..... 600/310
5,304,219 A * 4/1994 Chernoff et al. ..... 607/122
5,760,341 A * 6/1998 Laske et al. ..... 174/126.2
5,843,141 A * 12/1998 Bischoff et al. ..... 607/37
2003/0163171 A1 8/2003 Kast et al.

* cited by examiner

*Primary Examiner*—Tho D. Ta
*Assistant Examiner*—Vanessa Girardi
(74) *Attorney, Agent, or Firm*—Orrick Herrington & Sutcliffe LLP

(57) ABSTRACT

A modular electric terminal connector, in particular for a monobody defibrillation probe. This terminal includes a stacking of elementary cylindrical parts, alternatively conducting and insulating, each of which includes a central cavity receiving the sheath of a cable comprising several connection wires. An axial pin, placed on a casing at the free extremity of stacking, is connected to a respective connection wire to form an axial contact of the terminal. Rods passing through homologous borings formed in each part ensure axial and angular alignment of the various parts of stacking. The unit is solidarized by injection of an adhesive under pressure. Suitable openings make it possible to connect by laser welding the conducting elementary parts to the wires located in the sheath to form the annular contacts of the terminal.

11 Claims, 5 Drawing Sheets

FIG_7
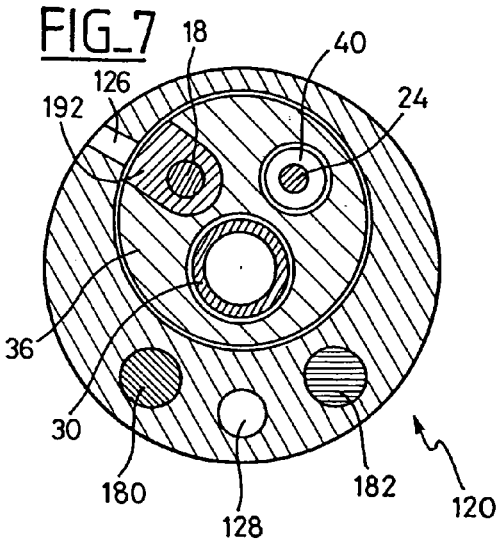
FIG_8
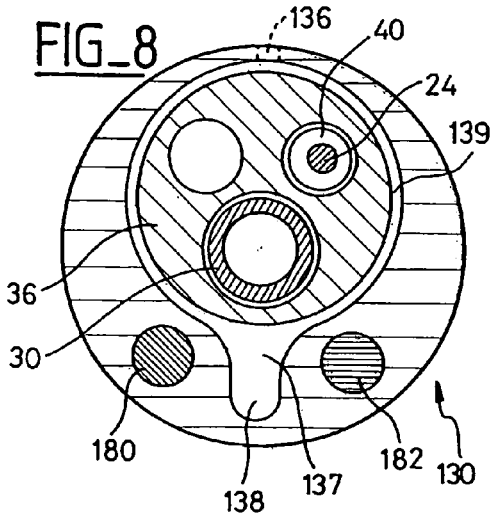
FIG_9
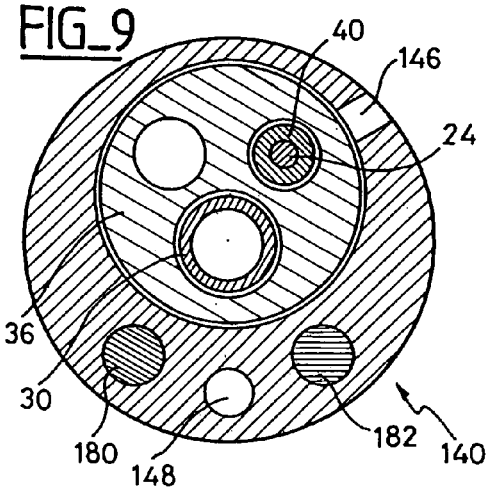
FIG_10
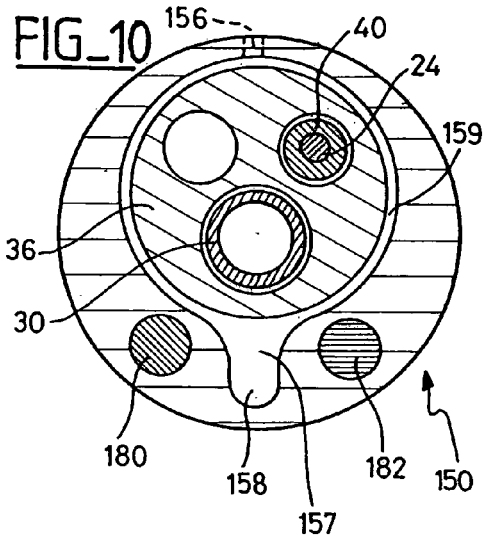
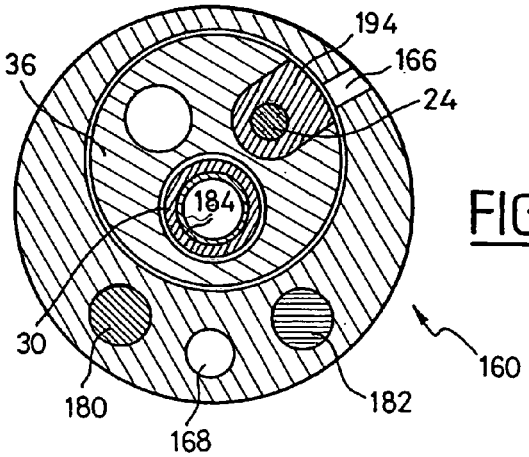
FIG_11

FIG_12
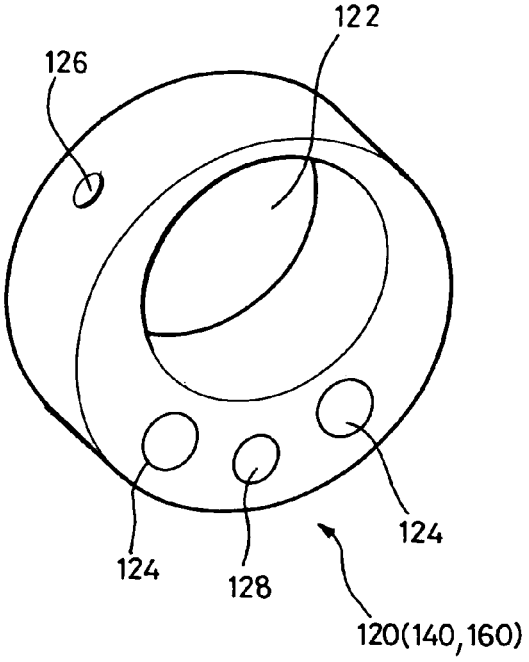
FIG_13
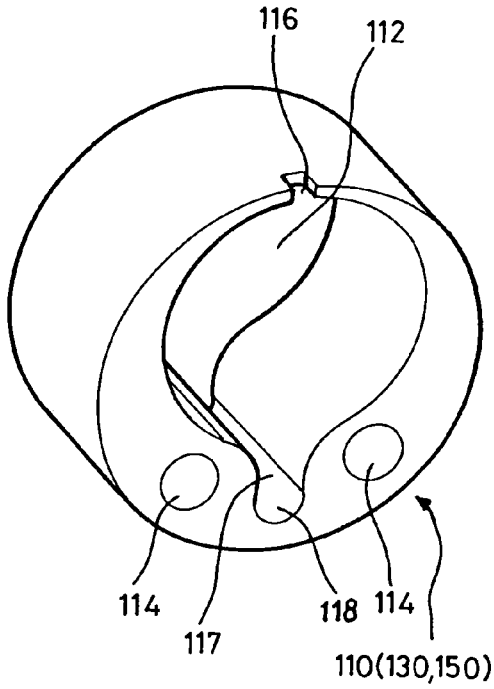
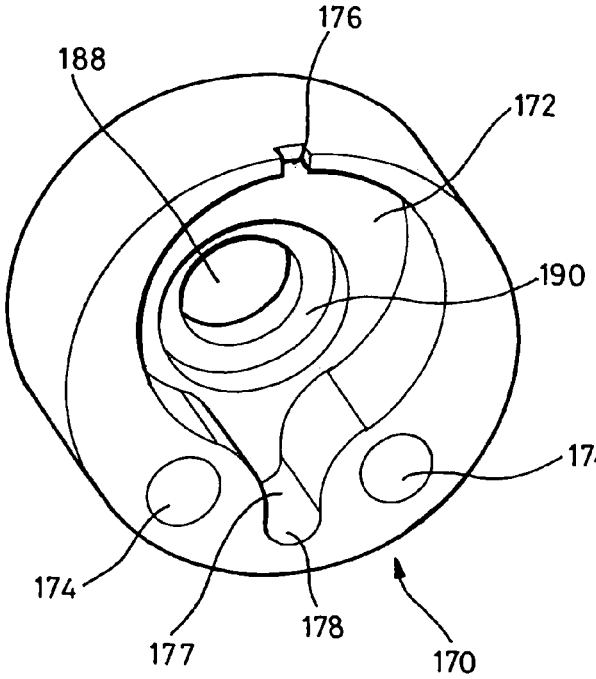
FIG_14

MODULAR ELECTRIC TERMINAL CONNECTOR, IN PARTICULAR FOR A MONO-BODY PROBE OF DEFIBRILLATION

FIELD OF THE INVENTION

The present invention relates to "active medical devices" as defined by the Jun. 14, 1993 directive 93/42/CE of the Council of the European Communities, and in particular, but in a nonrestrictive way, to "active implantable medical devices" as defined by the Jun. 20, 1990 directive 90/385/CE of that Council.

The invention will be mainly described within the framework of implantable defibrillators or implantable cardiovertors, which are implantable devices able to deliver to the heart pulses of high energy (i.e., pulses notably exceeding the energy provided for simple stimulation) to try to stop a tachyarythmia.

BACKGROUND OF THE INVENTION

Implementation of the invention is applicable to a very large variety of active medical devices, implantable or not, including in particular, in addition to the cardiac prostheses: neurological apparatuses, pumps for distribution of medical substances, cochlear implants, implanted biological sensors, etc. These devices comprise a case or a "generator" connected electrically and mechanically to one or more probes equipped with electrodes, whose role is to distribute energy to tissue, e.g., the heart.

There are standardized systems of connection, making possible interchangeability of probes and the generators produced by various manufacturers. The "IS-1" standard, for example, defines a certain number of dimensional and electric specifications relating to probes delivering impulses of low stimulation voltage.

For defibrillation probes or cardioversion, where electrical constraints are more severe given the high energy delivered by the generator to the probes, another standard known as "DF-1" defines the dimensional and electric specifications of the connection system.

In the case of "mono-body" probes, equipped at the same time with both stimulation (or sensing) electrodes and shock electrodes, it is foreseen, for example, a terminal with the IS-1 standard connected to a right ventricular distal detection/stimulation electrode, and two terminals with the DF-1 standard connected to two shock electrodes, respectively, a right ventricular electrode, and a "supraventricular" electrode, which is intended to be positioned in the higher vena cava for application of shock to the atrium. The complexity of such probes is expected to become even more complex in the future, in particular with development of multisite type devices and intracardiac sensors, such as peak endocavitary acceleration (PEA) sensors. The realization of mono-body probes integrating all these functions and becoming increasingly complex led to a multiplication of the connection terminals with in addition different standards between the terminals.

Work is currently underway for definition of a new connection standard for such probes, which would allow a single terminal carrying a plurality of contacts to simultaneously ensure establishment of connections at the various output of the generator for all energy levels: sensing of depolarization signals, application of stimulation impulses, or application of cardioversion or defibrillation shocks.

It is in particular considered, within the framework of this work, to define a standard where the single terminal would be of the "isodiameter" type, i.e., a uniform cylindrical form intended to be inserted into a homologous cavity within the generator, with sealing functions performed by elements incorporated in the head of the connector, unlike IS-1 and DF1 standards, which, on the contrary, impose the presence on each relief terminal of a sealing formed on the flexible insulating sleeve.

The realization of such an isodiameter terminal with multiple contacts, however, implies the resolution of many manufacturing problems, in particular because of manufacturing difficulties, taking into account the small dimensions (the considered diameter being only 3.2 mm) and the need for carrying out the electric connections between the contacts of the terminal and the various corresponding conductors in the probe while respecting the constraints of safety and reliability of this type of product, which is intended to be implanted in a patient. Another manufacturing aspect is the complexity related to the need to design and manufacture terminals adapted to various types of probes, for example, probes including or not including PEA sensors with configurations of bipolar or multipolar stimulation electrodes, etc. Each type of probe will correspond to a different terminal, or a different terminal plugging scheme, making more complex, and thus more expensive, manufacture of these terminals.

OBJECTS AND SUMMARY OF THE INVENTION

One of the goals of the invention is to cure these various disadvantages and limitations by proposing a structure of an isodiameter terminal with multiple contacts that is simple to manufacture, and which presents a modular character allowing one, starting from some basic elements, to obtain simply and quickly different terminals or different plugging schemes without having to significantly modify production equipment. This will allow the adoption of this type of terminal within the framework of a new system of standardized connection without introducing significant additional cost compared to existing systems (e.g., IS-1 and DF-1), while ensuring patient safety, and without compromising reliability and simplicity of implementation.

The terminal of the invention is assembled at the final extremity of a cable comprising connection wires extending longitudinally inside a tubular flexible sheath made of insulating material. This terminal is a rigid cylindrical terminal comprising on its surface a plurality of annular contacts distributed axially and separated by insulating areas, and comprising at its free extremity an axial contact.

In an embodiment of the invention, the terminal includes an axial stacking of alternatively conducting and insulating elementary cylindrical parts, each one including a central cavity extending axially throughout and able to accommodate the tubular sheath. Each conducting elementary part is connected to a respective connecting wire so as to form the aforesaid annular contacts of the terminal, and an axial pin is placed at the free extremity of the stacking and connected to a respective connecting wire so as to form the aforementioned axial contact of the terminal. The embodiment also can include means for axial and angular alignment of the various elementary stacked parts.

In a preferred embodiment of the invention, at least some of the elementary parts include a transfer channel of an adhesive injected under pressure, this transfer channel extending axially throughout the part. At least some of these parts can also include a passage radially extending between the transfer channel and the central cavity, to allow expansion of the adhesive under pressure from the transfer channel to the remaining space between the internal wall of the central cavity and the external surface of the tubular sheath lodged in the cavity. Advantageously, some of these parts can have an outlet channel extending radially between the central cavity and the external environment to allow ventilation of the space between the internal wall of the central cavity and the external surface of the tubular sheath lodged in this cavity.

In addition, at least some of the conducting elementary parts can include an access opening radially extending between the central cavity and the external environment and able to give access, for establishment of an electric connection, to a respective connecting wire located in the tubular sheath near the access opening. A conducting material bridge can then be formed in this access opening, preferably by laser welding from the outside of the terminal, to electrically connect the conducting elementary part to the respective connecting wire located in the tubular sheath near the access opening. To do this, the connecting wire can carry, in a region located near the access opening, an insert made out of conducting material lodged in a cavity of the tubular sheath, this insert being electrically connected to a respective connecting wire on the interior side, and leveling the surface of the tubular sheath on the external side.

The terminal can include at its final extremity an axial casing connected to a respective connection wire, and a pin forming the aforementioned axial contact of the terminal, placed on the axial casing. The final elementary part of stacking can then comprise an axial opening surrounded on its internal face by a facing able to cooperate with a peripheral shoulder formed on the axial casing.

The means for the axial and angular alignment of the various elementary parts of stacking can include one or more rods extending axially, fixed in a homologous section boring formed in each elementary part. One or more of these rods can also be a short-circuiting conducting rod of at least two conducting elementary parts.

BRIEF DESCRIPTION OF THE DRAWINGS

Further benefits, features, and characteristics of the present invention will become apparent to a person of ordinary skill in the art in view of the following detailed description of the invention, made with reference to the annexed drawings wherein:

FIGS. 7, 8, 9, 10, and 11 are transverse cross-sections of the respective cylindrical elementary parts 120, 130, 140, 150, and 160, in an assembled configuration of the terminal, including the tubular sheath of the probe with the various conductors that it includes; and FIGS. 12, 13, and 14 are perspective views for the elementary parts 120 (also 140 or 160), 110 (also 130 or 150), and 170, respectively, these parts being illustrated separately from the various elements of the terminal with which they will be associated.

DETAILED DESCRIPTION OF THE INVENTION

Figure 1:
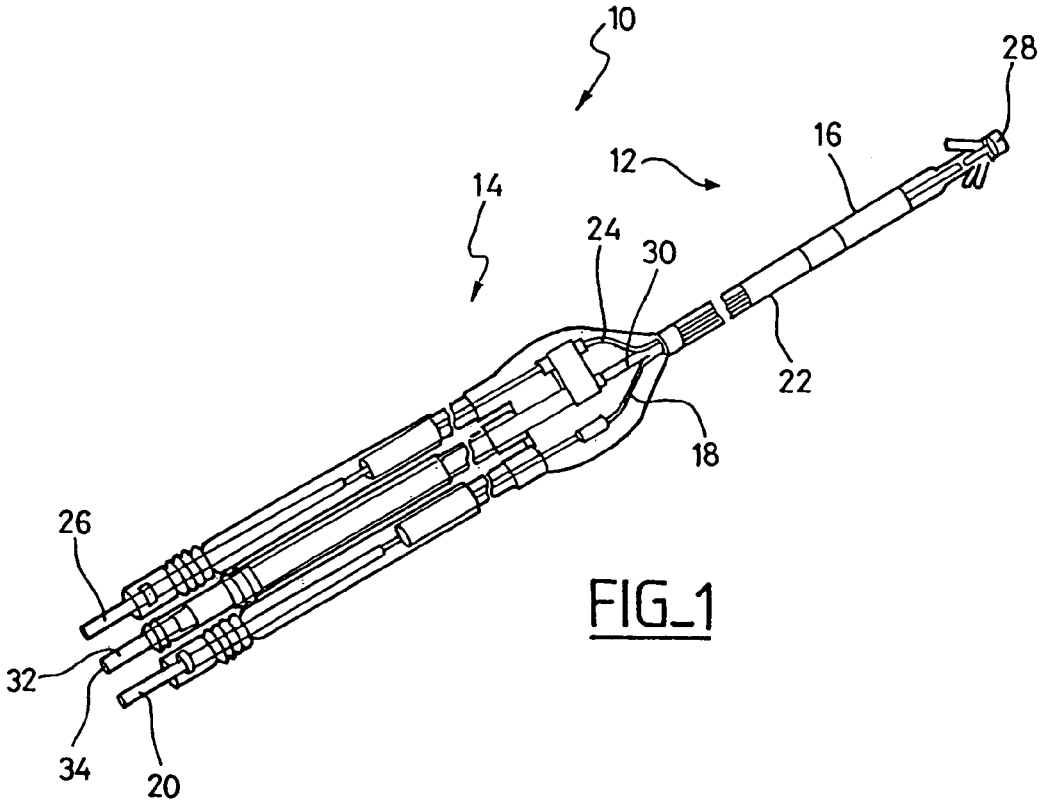
FIG. 1 is a perspective picture of a mono-body defibrillation probe of a known type.

In FIG. 1, reference 10 generally indicates a mono-body defibrillation probe of a known type. The distal part 12 of this probe is intended to be introduced by the venous network into the two atrial and ventricular cavities of a patient's heart, to detect there the cardiac activity and to apply as needed shocks for defibrillation or cardioversion. This probe 10 is provided at its proximal end 14 with various elements for connection to an adapted generator, for example, a generator of the Defender, Alto, Ovatio, or Lyra branded devices manufactured by ELA Médical, Montrouge, France.

Probe 10 carries a first shock electrode 16, intended to be in the right ventricle and constituting, for example, a negative terminal for application of a defibrillation or cardioversion voltage. This ventricular shock electrode 16 is connected by a connecting wire 18 to a connection terminal 20 of the generator (typically a terminal with the DF-1 standard).

Probe 10 also has a second shock electrode 22, which is a supra-ventricular electrode intended to be positioned in the higher vena cava for application of a shock to the atrium. This supra-ventricular shock electrode 22 is connected by another wire 24 to another connecting terminal 26 of the generator (typically also a terminal with the DF-1 standard).

Probe 10 is also equipped with a distal electrode 28, which is a detection/stimulation terminal electrode intended to be positioned to the bottom of the right ventricular cavity. This electrode 28 is connected by a wire 30 to a connection terminal 32 of the generator (typically with the IS-1 standard).

Figure 2:
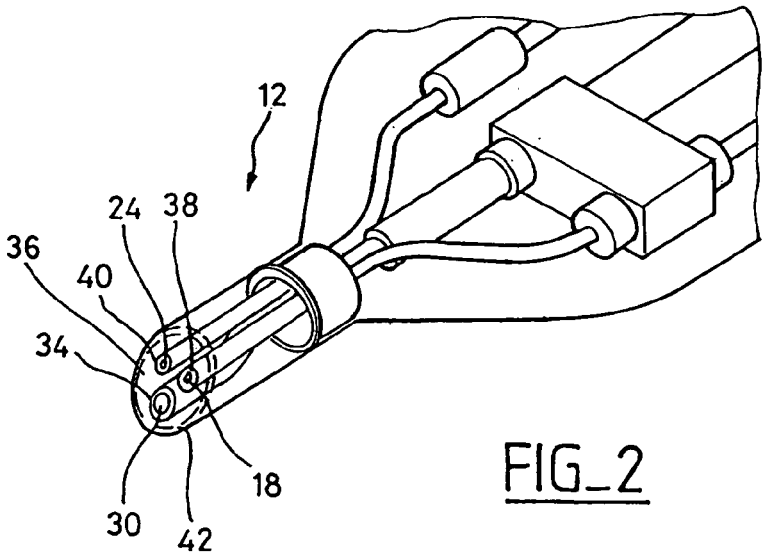
FIG. 2 is an enlarged perspective view of the proximal extremity of the tubular sheath of the probe of FIG. 1, at the place where this probe widens and is divided into a plurality of conductors, each connected to a distinct connection terminal.

FIG. 2 more precisely shows the configuration of three conductors 18, 24, and 30 in the distal tubular end 12 of probe 10. The conductors 18 and 24, which transmit the defibrillation or cardioversion energy, are micro-cables having their own insulators, respectively 38 and 40. Conductor 30 is, for example, a wound wire, with a hole 34 in its center allowing introduction of a stylet for the guidance of the distal tubular end of the probe 12 by the physician into the venous network when the probe is being implanted. These three conductors 18, 24, 30 are lodged inside tubular sheath 36 made out of flexible insulating material such as a silicone or any other material of suitable strength. For ease of introduction into the venous network, sheath 36 is wrapped on the outside with a coating 42 made out of material having a low coefficient of friction, for example, polyurethane.

The present invention proposes an electrical connector terminal adapted in particular (but not exclusively) to the above-described type of probe.

In the terminal of the present invention, the separate unipolar connection terminals 20, 26, and 32 (See FIG. 1) are replaced by a single cylindrical, multipolar terminal. Such and assembly ensures the electric connection of the various electrodes of the probe at the corresponding terminal outputs of the generator. Such a probe makes it possible to easily increase the number of contacts carried by the same terminal, which constitutes a particularly interesting aspect taking into account the increased need for connectivity in modern apparatuses, with the multiplication of the electrodes carried by the same probe and also the integration of sensors into the probe (for example, a sensor of PEA signal of endocavitary acceleration).

Figure 3:
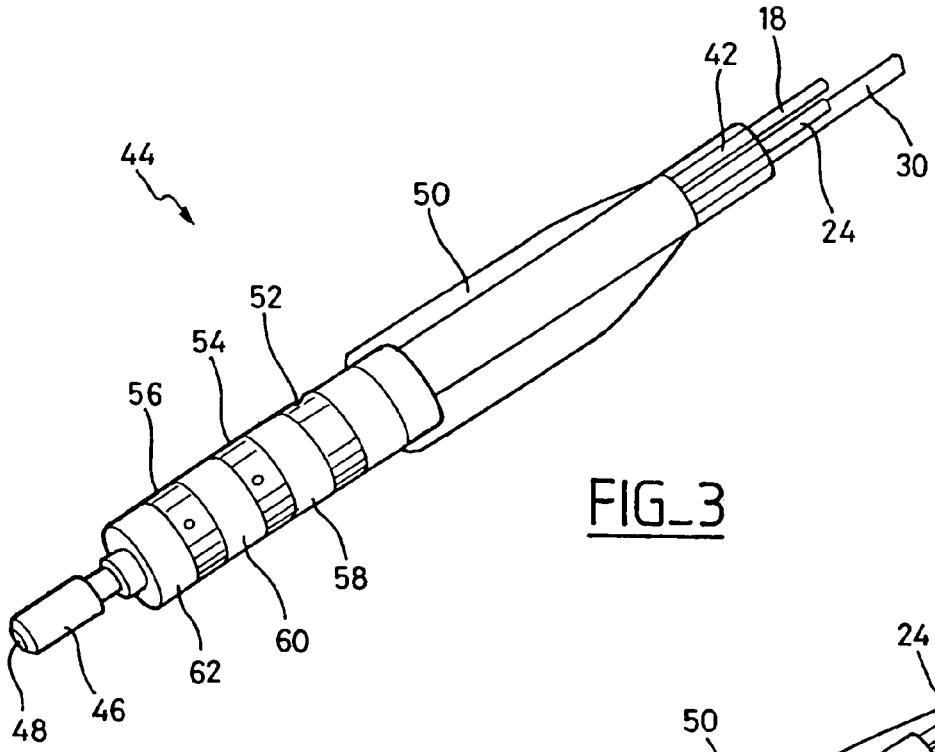
FIG. 3 is an overall picture, in perspective, of an isodiameter multicontact connection terminal according to the present invention, such as it is assembled at the proximal extremity of a mono-body defibrillation probe.
Figure 4:
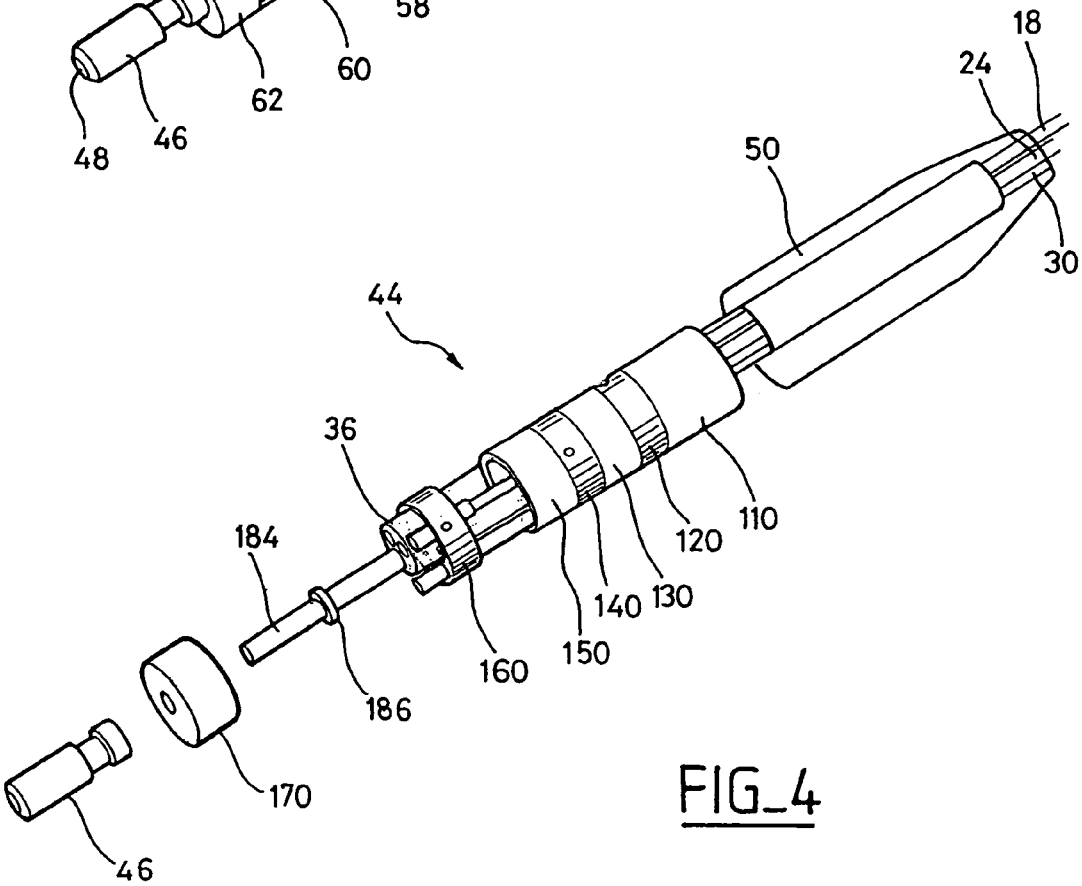
FIG. 4 is identical to FIG. 3, but in an exploded perspective.

FIGS. 3 and 4 are overall pictures of the terminal according to the present invention, respectively in assembled form and in an exploded view. Terminal 44 is a multipolar terminal whose free extremity carries an axial contact 46 with a hole 48 for allowing introduction of a stylet at the time the probe is implanted (this hole 48 having the same function as the hole 34 of the probe 14 illustrated in FIGS. 1 and 2). Between this axial contact 46 and an connection sleeve 50 connected to the flexible shaft 42 extends a plurality of successive annular contacts 52, 54, 56, separated from one another by insulating areas 58, 60, and from the axial contact 46 by insulating area 62. The set of annular contacts 52, 54, 56, and insulating areas 58, 60, 62, form a smooth isodiameter cylindrical unit that can be introduced into a homologous cylindrical cavity of a connector of generator (not shown).

In contrast to the IS-1 and DF-1 standards, the terminal does not carry a sealing element such as circular relief (as seen on the illustrated terminals in FIG. 1), this function being carried out by suitable elements located inside the cavity of the connector head of the generator. This makes it possible to have a cylindrical smooth and rigid surface, the gradient of stiffness between this rigid part and the flexible shaft 42 being managed by the insulating connection sleeve 50.

As illustrated in FIG. 4, various elements of the cylindrical rigid part consist of pieces in the form of alternatively conducting and insulating stacked cylindrical rings. More precisely, in the illustrated example of a terminal comprising three annular contacts and an axial contact, one finds seven stacked up parts, namely: a first insulating part 110 ensuring the transition with connection sleeve 50; a first conducting part 120 (constituting the first annular contact 52 shown in FIG. 3); a second insulating part 130; a second conducting part 140 (constituting the second annular contact 54 shown in FIG. 3); a third insulating part 150; a third conducting part 160 (constituting the third annular contact 56 shown in FIG. 3); and a fourth insulating part 170 insulating this third annular contact from the axial contact 46.

These successive parts 110 to 170, which will be described in more detail thereafter in reference to the FIGS. 5 to 14, show various characteristics making it possible to mechanically solidarize (interconnect) the various parts and to ensure electric connection to the various connecting wires 18, 24, 30 located inside the sheath 36, while ensuring a tight solidarisation, so as to constitute a solid probe throughout from beginning to end and presenting a high degree of electric insulation and mechanical robustness.

Figure 5:
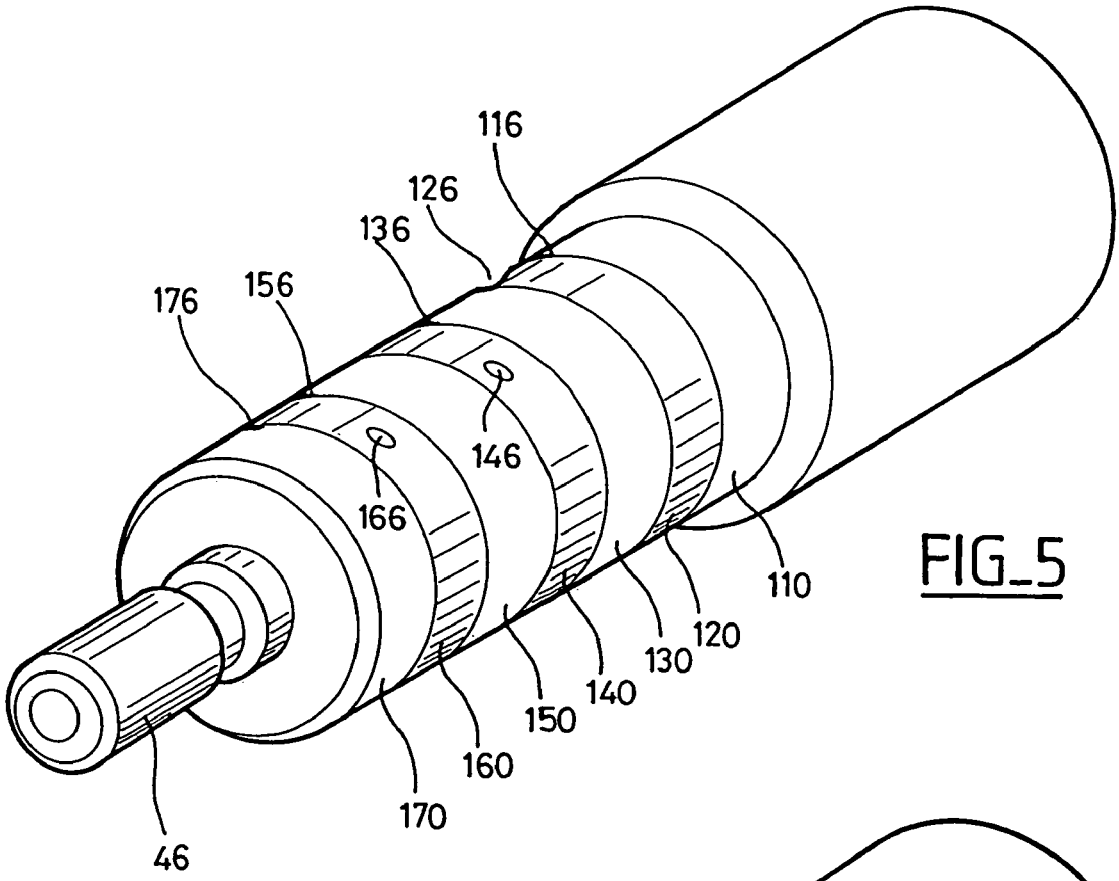
FIG. 5 shows in a more precise way the assembly of the various conducting and insulating elementary parts constituting the terminal of the invention.
Figure 6:
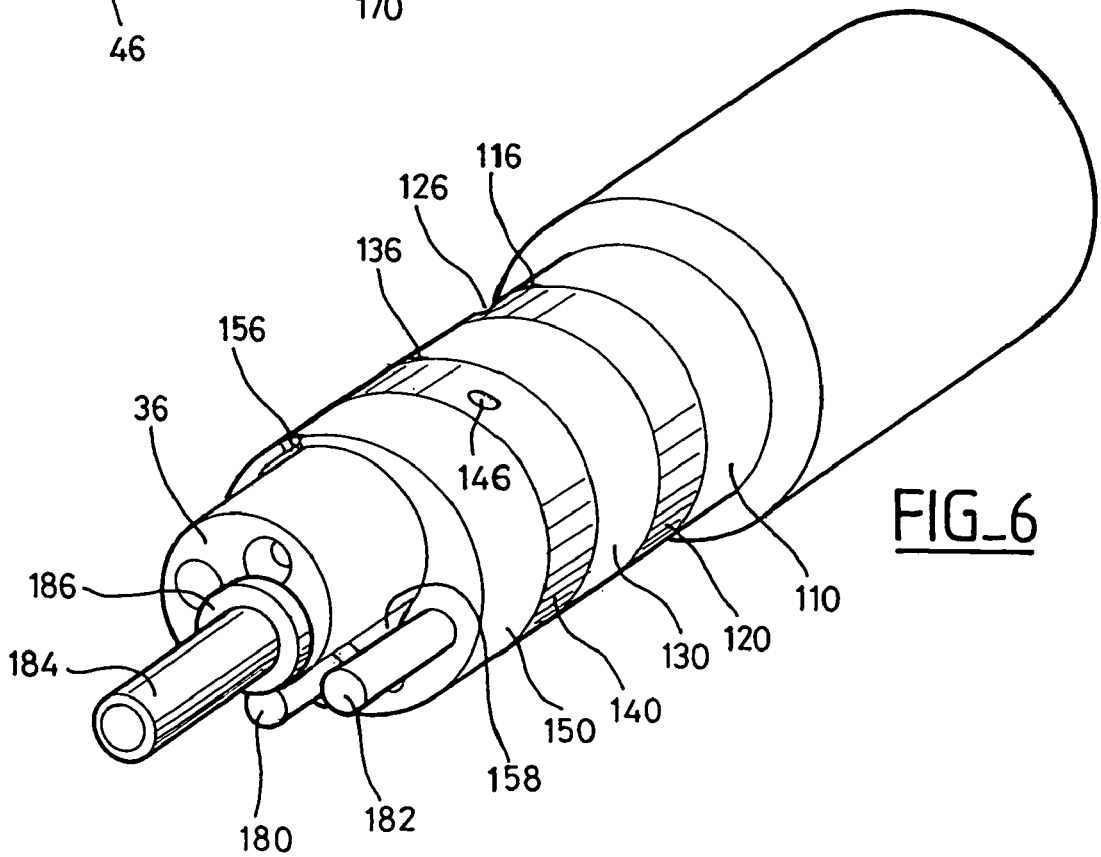
FIG. 6 is identical to FIG. 5, with the pin of extremity and two cylindrical elementary parts of the extremity not shown to give a better view of the other elements.

As illustrated in particular in FIGS. 5 and 6, the conducting parts 120, 140, and 160 present on the outside openings 126, 146, and 166 give access to connecting wires located in the sheath inside the terminal, while the insulating parts 110, 130, and 170 are equipped with radial channels 116, 136, 156, and 176 function as outlet channels to allow ventilation during injection of an adhesive under pressure inside the terminal for final assembly of the various parts.

As one can see more precisely in FIG. 6, it is foreseen for the assembly of the various parts of the stacking one or more axially directed rods 180, 182 crossing (passing through) all of the stacked parts, to allow precise angular (rotational and linear) alignment of these various parts. Moreover, the adjustment between the rods and corresponding borings of the various parts is advantageously selected so as to allow an assembly allowing the various parts stacked up to remain assembled between them due to the tight fit of the rods, even before injection of an adhesive to finally seal the parts in position.

The axial contact 46 (shown in FIGS. 4 and 5) is assembled, for example, by screwing on a casing 184 (shown in FIGS. 4 and 6) connected mechanically and electrically, for example, by crimping, to the conductor 30 (see FIG. 4) located inside sheath 36 (see FIG. 6). A peripheral shoulder 186 makes it possible to axially adjust the position of casing 184 before installation of the frontal insulating part 170 (described further in reference to FIG. 14).

For the conducting parts 120, 140, 160, and 46, it is possible to use a stainless steel of 316 L or LVM value, and for the insulating parts 110, 130, and 170, one can use a synthetic material such as Tecothane, which is an insulating and rigid derivative of polyurethane.

FIGS. 7 to 14 show in more detail the structure of the various conducting parts 120, 140, and 160 and of the insulating parts 110, 130, 150, and 170.

The first conducting part 120, illustrated in FIG. 7 in cross-section by a radial plan and shown in perspective in FIG. 12, includes: a central cavity 122 (see FIG. 12) allowing placement of the tubular sheath 36 (see FIG. 6); two borings 124 able to receive centering rods 180 and 182 (see FIG. 6); an opening 126 providing access to the conducting wire 18 located inside the tubular sheath 36 (see FIG. 6); and an adhesive transfer channel 128 whose role will be explained further below. The electric connection between the conducting part 120 and wire 18 is carried out by means of an insert 192 (see FIG. 7), which is advantageously a conducting material part lodged in a cavity of homologous size existing in the tubular sheath 36 (see FIG. 6). This insert 192 is electrically connected on the internal side to the conducting wire 18, for example, by crimping the insert to the conducting wire during assembly of the terminal. The insert 192 is then introduced into a homologous housing with the tubular sheath 36 (which is made out of flexible material). The mechanical and electric connection of insert 192 to the metal part 120 is then formed, for example, by laser welding, through access opening 126 (see FIG. 7).

Referring to FIGS. 9 and 11, the second and third conducting parts 140 and 160, respectively, have a structure comparable to that of the first conducting part 120, except for the angular position of the access openings to conducting wire 126 (see FIG. 7), 146 (see FIG. 9) and 166 (see FIG. 11).

The third conducting part 160, illustrated in FIG. 11, includes: a central cavity lodging the sheath 36; two borings able to receive rods 180 and 182; an access opening 166 to an insert 194 crimped on the wire 24 located in sheath 36; and an adhesive transfer channel 168. The electric and mechanical connection of the conducting part 160 with insert 194 is carried out by, for example, laser welding via the access opening 166.

With regard to the second conducting part 140, illustrated in FIG. 9, this one includes, in the same way: a central cavity lodging sheath 36; two borings able to receive rods 180 and 182; an access opening 146; and an adhesive transfer channel 148. However, in the illustrated example, this part 140 is not directly connected to the conducting wire located inside the sheath 36. It is simply connected electrically in derivation on part 160, this derivation being advantageously realized via one of the rods, for example, rod 182, by choosing a conducting material for the rod. It relates to a configuration known as a tripolar or pseudo-quadripolar configuration, i.e., with a terminal with four contacts for a probe comprising only three wires, with two contacts connected in parallel.

In the case of a true quadripolar configuration, i.e., a terminal with four contacts assembled on a probe with four conductors, it would be suitable to use the access opening 146 to electrically and mechanically connect the part 140 to a fourth conductor located inside the tubular sheath 36, for example, a conductor connected to a sensor integrated into the probe.

One now will describe the insulating parts 110, 130, 150, and 170, in reference to FIGS. 8, 10, 13, and 14. FIGS. 8 and 10 illustrate parts 130 and 150 in radial cross-section, while FIGS. 13 and 14 are perspectives of parts 110 and 170 taken separately (parts 130 and 150 being identical at piece 110 of FIG. 13). Each piece, for example, piece 110 illustrated on FIG. 13, comprises: a central cavity 112 (FIG. 13) for lodging sheath 36; two borings 114 for receiving rods 180 and 182; an outlet channel 116 used during injection of adhesive under pressure; and a passage 117 allowing expansion of the adhesive from adhesive transfer channel 118 towards the remaining space between the internal wall of the central cavity and the external surface of the tubular sheath. For parts 130 (FIG. 8), 150 (FIG. 10), and 170 (FIG. 14), the outlet channels are respectively referred to as 136, 156, and 176, the passages of expansion of the adhesive as 137, 157, and 177, and the adhesive transfer channels 138, 158, and 178.

The insulating part of extremity 170, illustrated in FIG. 14, comprises: a central cavity 172 intended to place the free part of the tubular sheath 36; two borings 174 for receiving the rods; an outlet channel 176 used during the injection of adhesive under pressure; and a passage 177 allowing the expansion of the adhesive from an adhesive transfer channel 178. Part 170 also comprises a central opening 188 of reduced diameter, equipped internally with a facing 190 co-operator with the peripheral shoulder 186 of casing 184 (FIG. 6)

With the difference of the conducting parts where the gap is the smallest possible between the central cavity and the tubular sheath 36 lodged in this central cavity, in the insulating parts a significant space remains between the cavity and the sheath, depicted as 139 and 159 in FIGS. 8 and 10. This will allow a sealing by joining of the various parts constituting the terminal: for this purpose, by means of a needle introduced axially at the back of part 110 into the alignment of adhesive transfer channels 118, 128 to channel 178 of part 170, an operator introduces the adhesive under pressure, for example, a traditional adhesive made of biocompatible silicone.

This adhesive thus fills channel 178, and then channel 177, and then filling up the space between the central cavity and the tubular sheath 36 will eventually come to meet at a point diametrically opposite, i.e., at the outlet channel 116 (see FIG. 13). This outlet channel plays here a double role: ventilation (to allow progression of the face of adhesive) and allowing one to know when injection of adhesive for this point can be stopped. Indeed, as soon as the adhesive arrives at this channel 116, the operator will know that injection of adhesive in this part 110 has been completely carried out. The operator then moves back the needle slightly so that its extremity comes to emerge at channel 128, and reiterates the operation for gradually furnishing the space remaining between the sheath and cavity 122 of part 120, until seeing the adhesive arising at the ventilation opening 126. And so on for injection of adhesive in the successive parts 130, 140 to the part of extremity 170, where the appearance adhesive by the outlet channel 176 will signal that injection of adhesive can be stopped.

The hardening of the adhesive definitively solidarizes the various parts, which thus will give a particularly robust, solid and well-sealed terminal and perfectly seals.

As one could easily understand, the structure of the terminal can be easily modified, for example, by adding/substacting a conducting piece and an insulating piece to obtain a terminal with five/three contacts instead of four, by modifying the plugging chart of the various contacts to the wire of internal connection of the probe according to the type of probe, etc. This flexibility of implementation contributes to a very great modularity of the system and to significant economies as well at the stages of design and manufacture.

One skilled in the art will appreciate that the present invention can be practiced by other than the described embodiments, which are presented for purposes of illustration and not of limitation.

I claim:

1. An isodiameter electrical connector terminal comprising a plurality of connecting wires extending longitudinally inside a tubular sheath made out of a flexible insulating material, said terminal having a surface and a free extremity, and comprising on said surface a plurality of annular contacts distributed axially and separated by insulating areas, and comprising at said free extremity an axial contact, said connector terminal characterized in that it further comprises:

an axial stacking of alternatively conducting and insulating elementary cylindrical parts sharing a same single diameter and comprising central cavities extending axially throughout the parts for receiving therein said tubular sheath, each conducting elementary part being electrically connected to a respective connecting wire to form said annular contacts of the terminal; wherein at least one of the conducting elementary parts further comprises an opening access extending radially between the central cavity and the external environment to give access to the respective connecting wire located in the tubular sheath; wherein a conducting material bridge is formed in said opening access to electrically connect the conducting elementary part to the respective connecting wire;

an axial pin placed at the free extremity and connected to a respective connecting wire to form said axial contact of the terminal; and means for axial and angular alignment of the elementary parts of the stacking.

2. The connector terminal of claim 1, wherein said conducting material bridge is formed by laser welding operated from outside said terminal.

3. The connector terminal of claim 1, wherein said connecting wire comprises an insert lodged in a cavity of the tubular sheath, said insert being electrically connected to an interior side of a respective connecting wire.

4. A defibrillation mono-body probe comprising a tubular sheath made out of flexible insulating material, said sheath having a distal extremity and a proximal extremity and being provided at said distal extremity with a plurality of electrodes connected to respective connecting wires extending longitudinally inside said sheath, and at its proximal extremity with the connection terminal recited in claim 1.

5. The connector terminal of claim 1, wherein at least one of said elementary cylindrical parts comprises an adhesive transfer channel extending axially throughout the part.

6. The connector terminal of claim 5, wherein said at least one of said elementary cylindrical parts comprises a passage radially extending between said transfer channel and said central cavity to allow expansion of adhesive from the transfer channel to a space between an internal wall of the central cavity and an external surface of the tubular sheath received in said cavity.

7. The connector terminal of claim 6, wherein said at least one of said elementary cylindrical parts further comprises an outlet channel extending radially between the central cavity and the external environment and able to allow ventilation of a space between an internal wall of the central cavity and an external surface of the tubular sheath received in said cavity.

8. The connector terminal of claim 1, further comprising at its final extremity an axial casing connected to a respective connecting wire, and a pin forming the axial contact of the terminal, placed on the axial casing.

9. The connector terminal of claim 8, wherein one of the elementary parts is disposed distally to the other elementary parts and further comprises an axial opening surrounded on its internal face by a facing able to cooperate with a peripheral shoulder formed on the axial casing to axially fix said one elementary part to said shoulder.

10. The connector terminal of claim 1, wherein the means for axial and angular alignment of said elementary parts of the stacking comprises at least one rod extending axially, fixed in a boring formed in each said elementary cylindrical part.

11. The connector terminal of claim 10, in which said at least one rod is a conducting rod for short-circuiting at least two conducting elementary parts.

* * * * *